US009407027B2

(12) United States Patent
Yoshida et al.

(10) Patent No.: US 9,407,027 B2
(45) Date of Patent: Aug. 2, 2016

(54) DEVICE CONNECTOR

(71) Applicant: Sumitomo Wiring Systems, Ltd., Yokkaichi, Mie (JP)

(72) Inventors: Keiichi Yoshida, Yokkaichi (JP); Hiroyuki Matsuoka, Yokkaichi (JP); Takuya Tate, Yokkaichi (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 14/525,271

(22) Filed: Oct. 28, 2014

(65) Prior Publication Data

US 2015/0132987 A1 May 14, 2015

(30) Foreign Application Priority Data

Nov. 12, 2013 (JP) ..... 2013-233916

(51) Int. Cl.

| | |
|---|---|
| ***H01R 13/504*** | (2006.01) |
| ***H01R 13/405*** | (2006.01) |
| *H01R 13/622* | (2006.01) |
| *H01R 25/16* | (2006.01) |
| *H01R 25/00* | (2006.01) |
| *H01R 13/639* | (2006.01) |
| *H01R 13/52* | (2006.01) |
| *H01R 4/34* | (2006.01) |

(52) U.S. Cl.

CPC ..... *H01R 13/504* (2013.01); *H01R 13/405* (2013.01); *H01R 4/34* (2013.01); *H01R 13/5219* (2013.01); *H01R 13/622* (2013.01); *H01R 13/639* (2013.01); *H01R 25/006* (2013.01); *H01R 25/16* (2013.01); *H01R 2201/26* (2013.01)

(58) Field of Classification Search

CPC .. H01R 25/006; H01R 25/16; H01R 13/5219; H01R 13/622; H01R 13/639

USPC ..... 439/362, 660

See application file for complete search history.

(56) References Cited

U.S. PATENT DOCUMENTS

| | | | | |
|---|---|---|---|---|
| 8,523,604 | B2 * | 9/2013 | Akuta | H01R 4/38 439/502 |
| 8,608,515 | B2 | 12/2013 | Tate et al. | |
| 2012/0238149 | A1 * | 9/2012 | Tate | B29C 45/14065 439/660 |
| 2013/0016493 | A1 * | 1/2013 | Cook | H01R 13/514 361/827 |

* cited by examiner

*Primary Examiner* — Abdullah Riyami
*Assistant Examiner* — Justin Kratt
(74) *Attorney, Agent, or Firm* — Gerald E. Hespos; Michael J. Porco; Matthew T. Hespos

(57) ABSTRACT

A device connector (10) includes conductive members (18) that electrically connect a device (11) and a mating connector (13) and a device-side housing (26) in which the conductive members (18) are held. The device-side housing (26) includes primary molded parts (36) in which the conductive member (18) is arranged and include a nut holding portion (37) for holding a nut (35) and a secondary molded part (42) that is formed integrally to the primary molded parts (36) and includes a receptacle (30) into which the mating connector (13) is to be fitted. The conductive member (18) includes a mating terminal connecting portion (34) to be connected to a mating terminal (17). The nut (35) is arranged in the receptacle (30) and a bolt (19) inserted through the mating terminal (17) and the mating terminal connecting portion (34) and is engaged with the nut (35).

9 Claims, 6 Drawing Sheets

DEVICE CONNECTOR

BACKGROUND

1. Field of the Invention

The invention relates to a device connector.

2. Description of the Related Art

U.S. Pat. No. 8,608,515 discloses a device connector to be mounted on a device such as a motor installed in a vehicle such as an electric vehicle or a hybrid vehicle and connected to a mating terminal. This device connector includes a device-side housing made of synthetic resin and to be mounted on the device and a conductive member arranged in the device-side housing and configured to electrically connect the device and the mating terminal. The conductive member includes a connecting portion to be connected to the mating terminal.

A bolt is inserted through the connecting portion and the mating terminal in a direction intersecting with plate surfaces of the connecting portion and the mating terminal in a state where the connecting portion and the mating terminal are placed one over the other. A nut is arranged at a position of the connecting portion opposite to the mating terminal. By threadably engaging the bolt with this nut, the connecting portion and the mating terminal are electrically connected.

According to the above configuration, the nut is mounted into the device-side housing in a direction parallel to the plate surface of the connecting portion. Thus, an opening through which the nut is inserted into a receptacle is formed on a side of the receptacle formed to project from the device-side housing in such a manner as to surround the connecting portion.

At least an opening area required to mount the nut into the receptacle needs to be ensured for this opening. Further, since this opening needs to be sealed in a liquid-tight manner, the receptacle is required to have a configuration for sealing the opening in a liquid-tight manner. In the case of providing the receptacle with the opening for mounting the nut in this way, it is difficult to reduce the height of the receptacle. Thus, there has been a problem of being difficult to reduce the height of the device connector.

The invention was completed based on the above situation and aims to provide a device connector with a reduced height.

SUMMARY OF THE INVENTION

The invention is directed to a device connector to be mounted on a device and connected to a mating connector, including a conductive member which electrically connects the device and the mating connector, and a device-side housing in which the conductive member is held, wherein the device-side housing includes a primary molded part in which the conductive member is arranged and which is made of synthetic resin and includes a nut holding portion for holding the nut and a secondary molded part which is integrally formed to the primary molded part and includes a tubular receptacle into which the mating connector is to be fitted; and the conductive member includes a mating terminal connecting portion to be connected to a mating terminal arranged in the mating connector, the nut is arranged in the receptacle and a bolt inserted through the mating terminal and the mating terminal connecting portion is threadably engaged in a state where the mating terminal and the mating terminal connecting portion are placed one over the other.

According to the invention, by molding the secondary molded part including the receptacle after the nut is held in the primary molded part, the nut can be arranged inside the receptacle without providing an opening, through which the nut is press-fitted, on a side wall of the receptacle. As a result, the height of the receptacle can be reduced, and the height of the device connector as a whole can be reduced.

A surface of the mating terminal connecting portion on which the mating terminal is to be placed may arranged at a position at the same height as a projecting end edge of the receptacle or arranged inside the receptacle. Thus, the mating terminal connecting portion is prevented from projecting outwardly from the projecting end edge of the receptacle. In this way, the contact of an operator with the mating terminal connecting portion in a connecting operation of the mating connector and the device connector is suppressed. In this way, safety in the connecting operation of the mating connector and the device connector can be improved.

According to the present invention, it is possible to provide a device connector with a reduced height.

DETAILED DESCRIPTION

Figure 1:
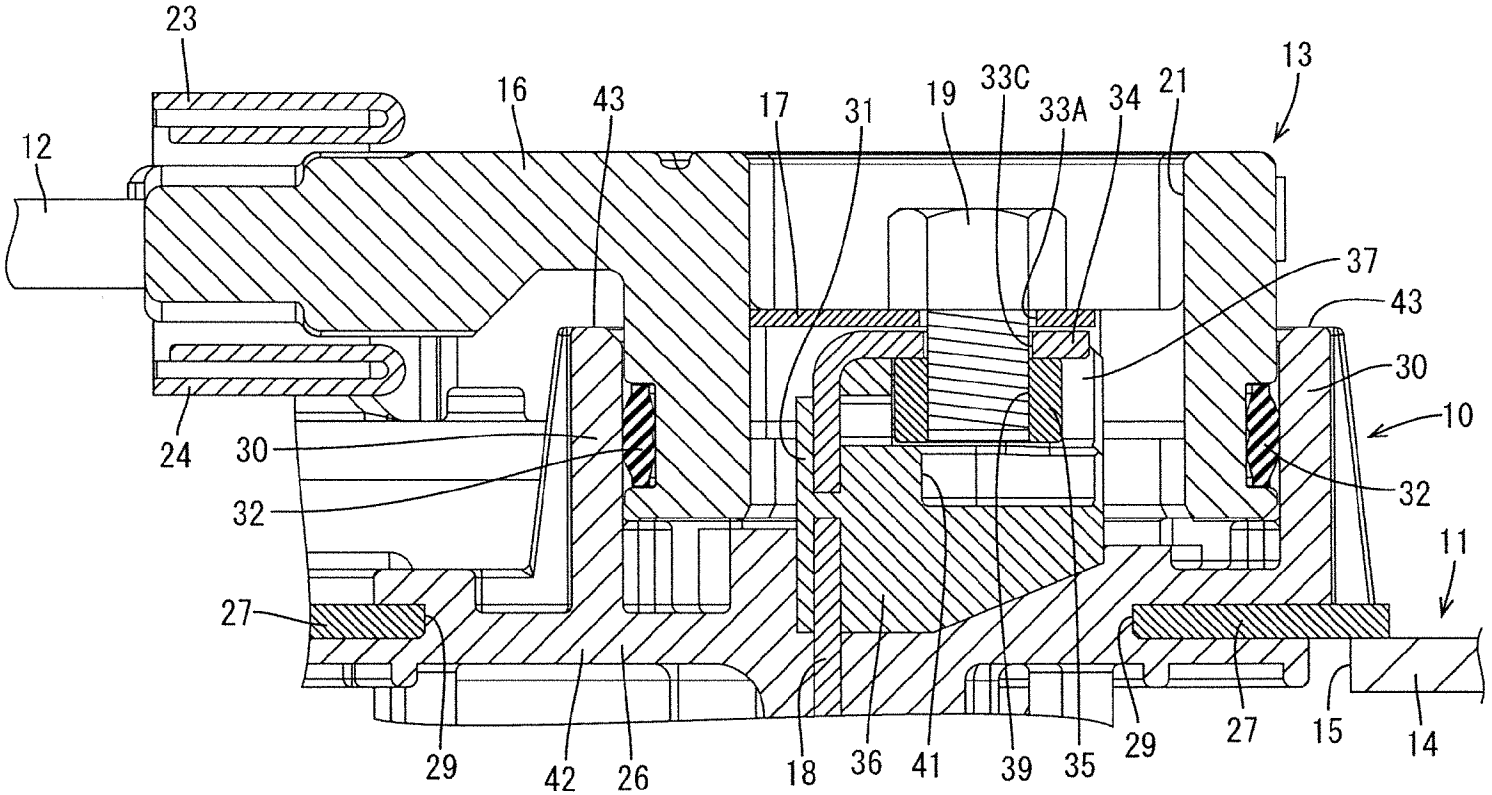
FIG. 1 is a section showing a state where a device connector according to an embodiment of the present invention and a mating connector are connected.

An embodiment of the invention is described with reference to FIGS. 1 to 6. A device connector 10 according to this embodiment is mounted on a device 11 such as a motor or an inverter installed in a vehicle (not shown) such as an electric vehicle or a hybrid vehicle. The device connector 10 is connected to a mating connector 13 connected to end parts of wires 12 arranged in the vehicle. By connecting the device connector 10 and the mating connector 13, the device 11 and the wires 12 are electrically connected. In the following description, upper and lower sides in FIG. 1 are referred to as upper and lower sides and right and left sides in FIG. 1 are referred to as front and rear sides. Further, for a plurality of members having the same shape, one member may be denoted by a reference sign and the other member(s) may not be denoted in the drawings.

The device 11 includes a case 14 made of metal and having an electromagnetic shield function. The case 14 is formed with a vertical through hole 15 that penetrates through the case 14 and in which the device connector 10 is to be mounted.

Figure 2:
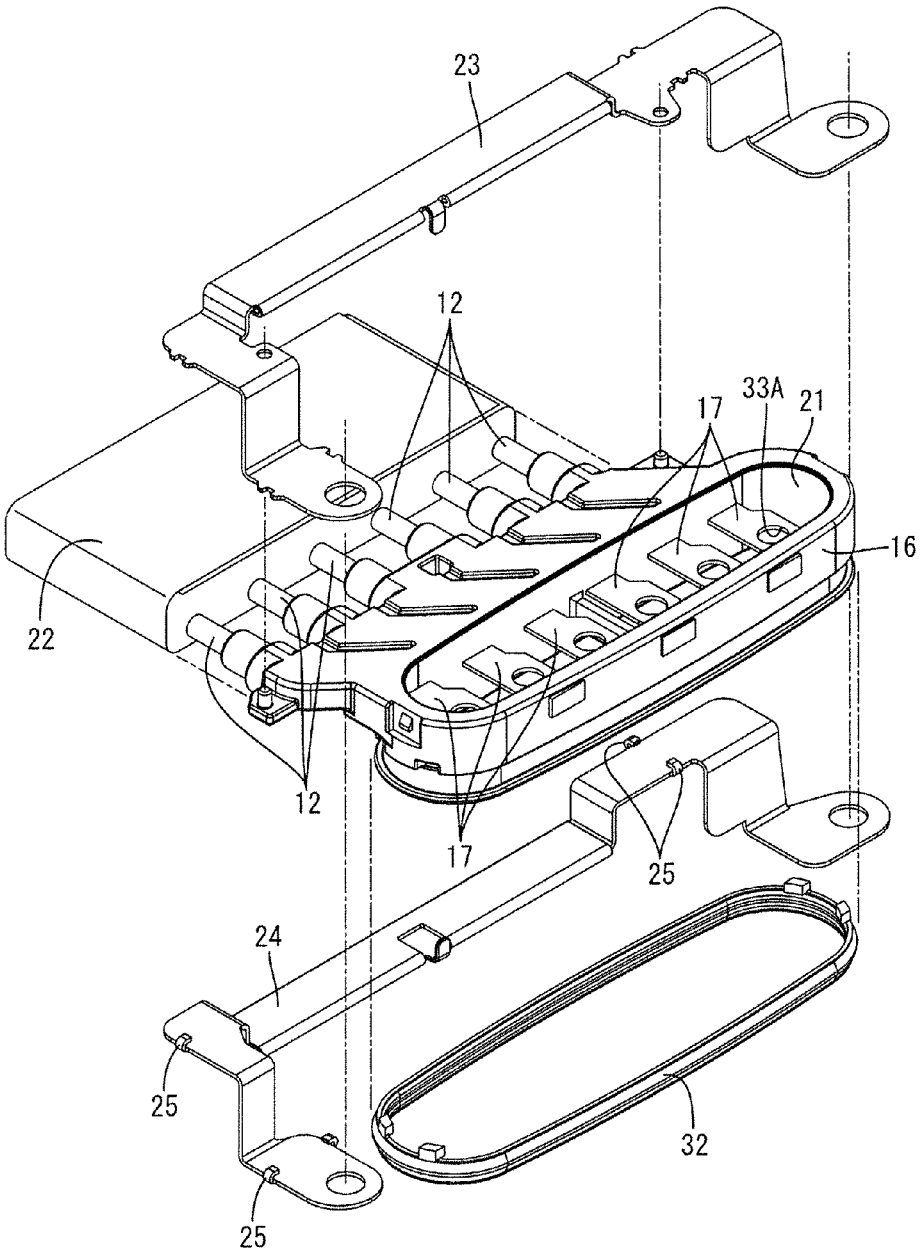
FIG. 2 is an exploded perspective view showing the mating connector.
Figure 3:
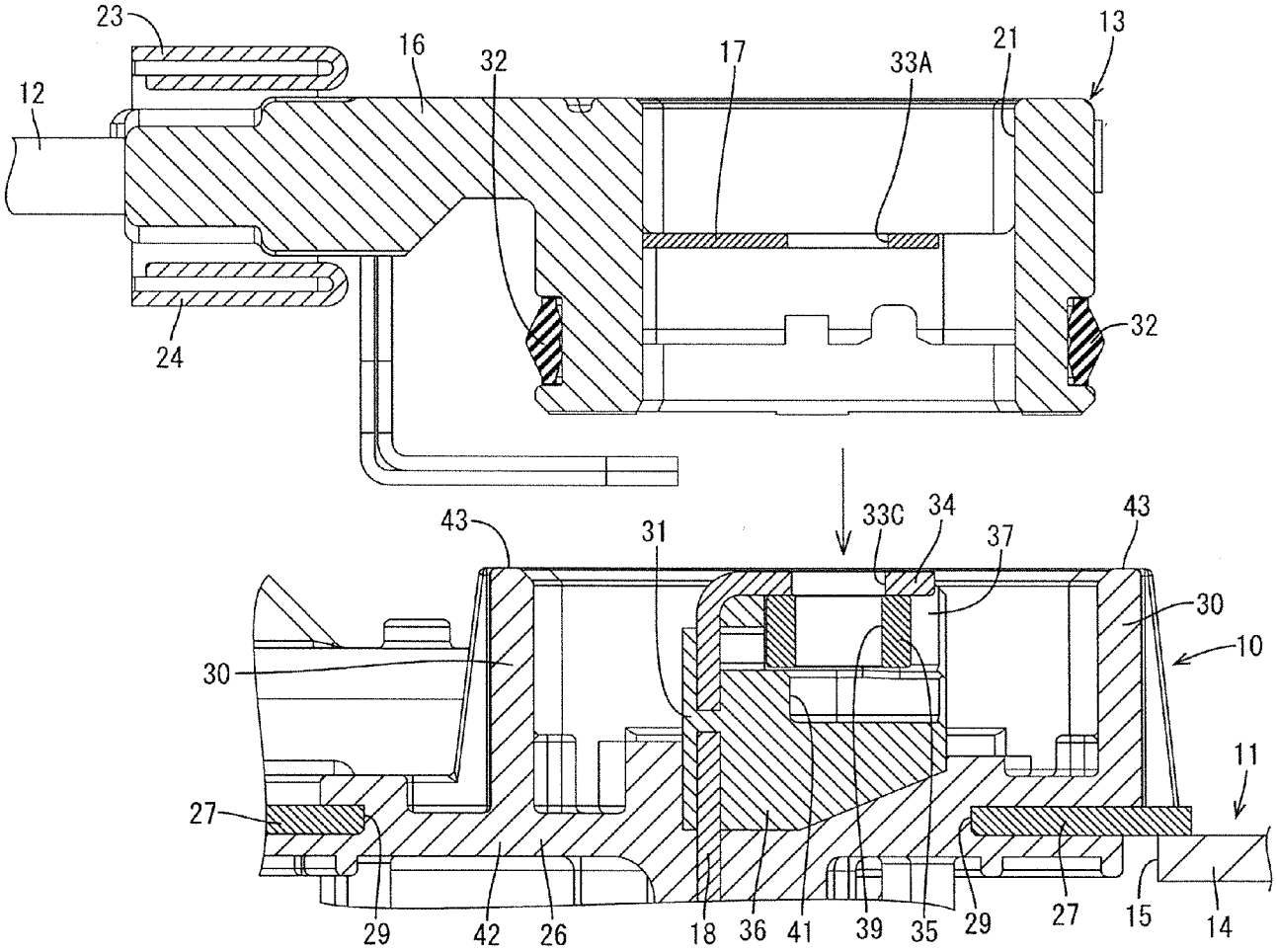
FIG. 3 is a section showing a state before the device connector and the mating connector are connected.

As shown in FIGS. 2 and 3, the mating connector 13 includes a mating housing 16 made of synthetic resin and mating terminals 17 arranged in the mating housing 16. The mating terminals 17 are connected to ends of the wires 20 by a known technique such as crimping. In this embodiment, the mating terminals 17 and the wires 12 are integrally formed to the mating housing 16 by being insert-molded with synthetic resin.

A tip of the mating terminal 17 is plate-like and electrically connected to a conductive member 18 to be described later. A bolt insertion hole 33A penetrates through a tip part of the mating terminal 17 and can receive a bolt 19. The mating terminal 17. An is made of a metal such as copper, copper alloy, aluminum, aluminum alloy, iron or stainless steel. A plating layer (not shown) made of metal such as tin or nickel may be formed on a surface of the mating terminal 17.

The mating housing 16 is formed into a vertically open tubular shape. An opening of the mating housing 16 defines a work hole 21 into which a tool or the like is inserted to fasten the bolts 19. The work hole 21 is closed in a liquid-tight manner by mounting an unillustrated cap from above after a bolt fastening operation.

Wires 12 are drawn out from the mating housing 16 in a direction intersecting with (in this embodiment, a direction substantially perpendicular to) an opening direction of the work hole 21. The wires 12 are collectively surrounded by a tubular braided wire 22 made of metal thin wires. One end part of the braided wire 22 is held vertically onto the mating housing 16 by an upper bracket 23 and a lower bracket 24.

Positioning pins project up from the mating housing 16 and are inserted from below into positioning holes formed on the upper bracket 23 to position the upper bracket 23 with respect to the mating housing 16.

Locking claws 25 project from side edges of the lower bracket 24 and are folded onto the upper bracket 23 for integrally assembling the upper and lower brackets 23, 24.

The upper and lower brackets 23, 24 are formed by press-working a metal plate material, such as copper, copper alloy, aluminum, aluminum alloy, iron or stainless steel, into a predetermined shape. Plating layers (not shown) made of metal such as tin or nickel may be formed on surfaces of the upper and lower brackets 23, 24.

As shown in FIG. 1, the device connector 10 includes conductive members 18 for electrically connecting the device 11 and the mating connector 13, and a device-side housing 26 made of synthetic resin holds the conductive members 18.

The device-side housing 26 is insert-molded with a plate 27 made of metal, such as aluminum, aluminum alloy, copper, copper alloy, iron or stainless steel.

Figure 5:
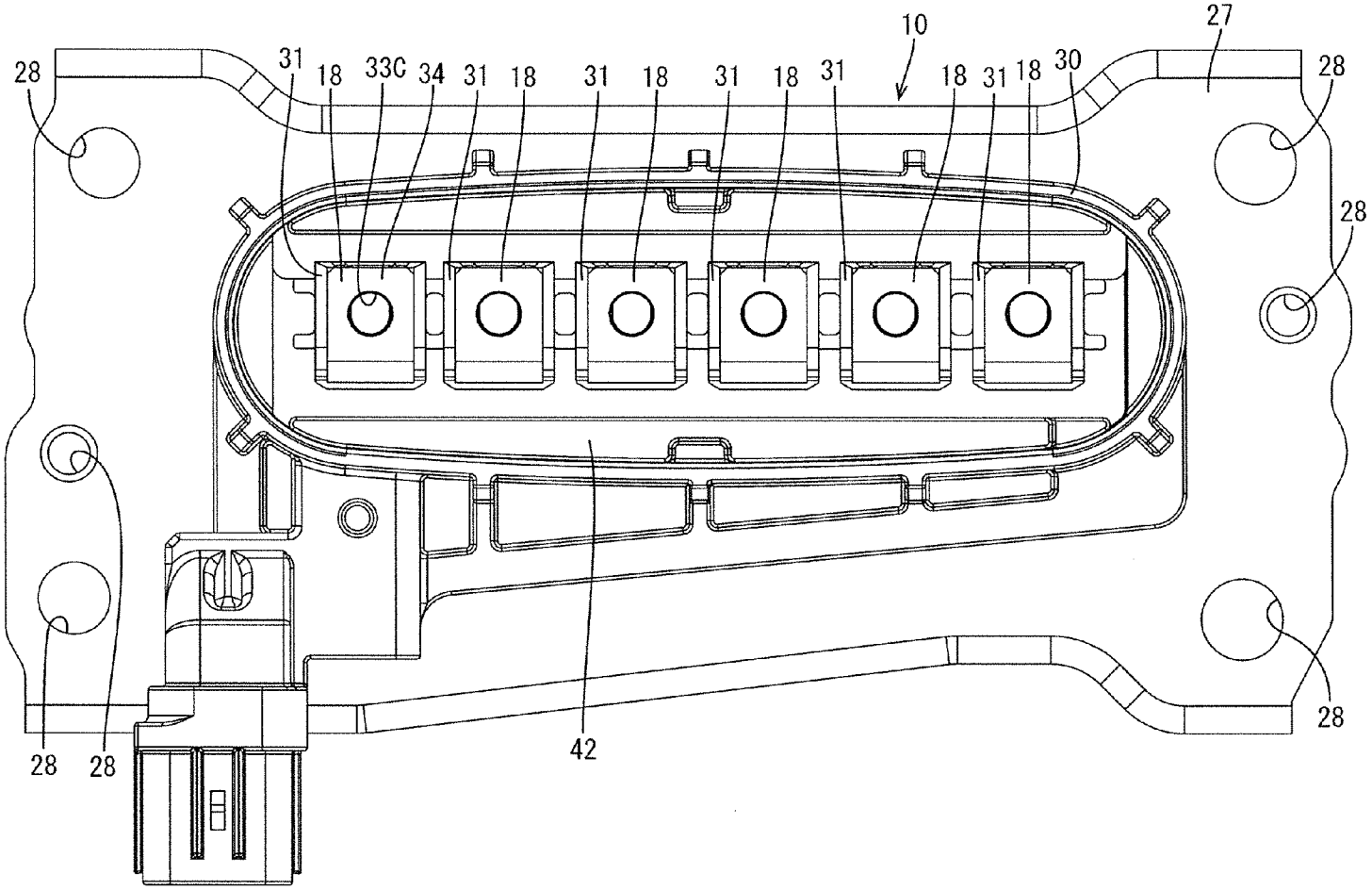
FIG. 5 is a plan view showing the device connector.

As shown in FIG. 5, the plate 27 is formed with a mounting holes 28 through which bolts (not shown) for fixing the plate 27 to the device 11 are inserted. As shown in FIG. 1, an opening 29 penetrates the plate 27 in a plate thickness direction.

As shown in FIG. 1, the device-side housing 26 is formed integrally to the plate 27 in such an arrangement as to penetrate through the opening 29 formed on the plate 27 in the vertical direction. The device-side housing 26 is inserted into the through hole 15 in the case 14 when the plate 27 is mounted on the case 14 of the device 11.

The device-side housing 26 includes a receptacle 30 that projects in a direction intersecting a plate surface of the plate 27 (upward direction in FIG. 1) and into which the mating connector 13 is to be fit. As shown in FIG. 5, the receptacle 30 has a long and narrow elliptical or oval shape when viewed from above. Terminal blocks 31 project up from the bottom surface of the receptacle 30 and a conductive member 18 is arranged on each terminal block 31.

As shown in FIG. 1, a seal ring 32 is fit externally on the outer surface of the mating connector 13 and is held in close contact with the inner wall surface of the receptacle 30 when the mating connector 13 and the device connector 10 are connected. The close contact of the seal ring 32 and the inner wall surface of the receptacle 30 seals between the receptacle 30 and the mating housing 16 in a liquid-tight manner.

Figure 4:
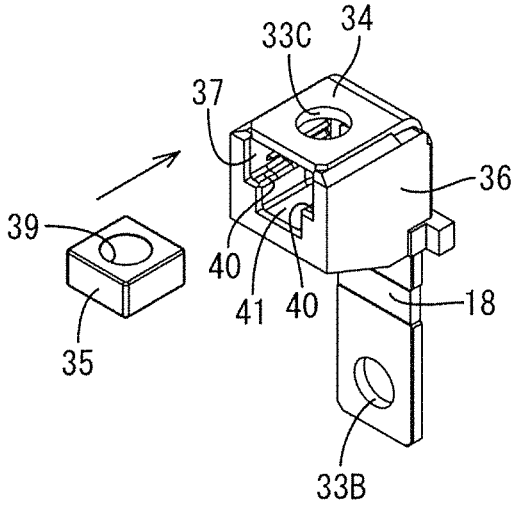
FIG. 4 is a perspective view showing a state before a nut is press-fitted into a nut holding portion of a primary molded part.

The conductive member 18 is formed by press-working a metal plate material, such as copper, copper alloy, aluminum, aluminum alloy, iron or stainless steel, into a predetermined shape. A plating layer made of metal such as tin or nickel is formed on a surface of the conductive member 18. As shown in FIGS. 3 and 4, the conductive member 18 extends in the vertical direction and is formed into a substantially L shape when laterally viewed.

As shown in FIG. 4, a bolt insertion hole 33B penetrates through a lower part of the conductive member 18 and can receive an unillustrated bolt. The bolt is inserted into the bolt insertion hole 33B and threadedly engages it with the device 11 to connect the device 11 and the conductive member 18 electrically.

An upper part of the conductive member 18 is bent substantially at a right angle and defines a mating terminal connecting portion 34 to be connected to the mating terminal 17. A bolt insertion hole 33C penetrates the mating terminal connecting portion 34 in the vertical direction and can receive a bolt 19. As shown in FIG. 1, the mating terminal 17 is placed on a surface of the mating terminal connecting portion 34 opposite to the terminal block 31 (upper surface in this embodiment) is fixed by the bolt 19.

The mating terminal 17 and the mating terminal connecting portion 34 are connected electrically by placing the mating terminal 17 and the mating terminal connecting portion 34 one over the other in the vertical direction. The bolt 19 then is inserted through the bolt insertion hole 33A of the mating terminal 17 and the bolt insertion hole 33C of the mating terminal connecting portion 34 and threadedly engaged with a nut 35 to be described later.

As shown in FIG. 4, the conductive member 18 is arranged in a primary molded part 36 made of synthetic resin. In this embodiment, the primary molded part 36 is formed integrally to the conductive member 18 by insert-molding the conductive member 18 with synthetic resin.

The primary molded part 36 is formed with a forwardly open nut holding portion 37 for holding the nut 35 at a position below the mating terminal connecting portion 34. The nut 35 is inserted into the nut holding portions 37 from front.

The nut 35 has a rectangular parallelepipedic shape flat in the vertical direction and a screw hole 39 penetrates the nut 35 in the vertical direction.

Placing portions 40 project inward from inner surfaces of a pair of side walls of the nut holding portion 37 and the nut 35 can be placed thereon. The nut 35 is press-fit into the nut holding portion 37 from the front. In this way, the nut 35 is pressed laterally by the side walls of the nut holding portion 27 at the position below the mating terminal connecting portion 34, thereby being retained so as not to come out forward. Further, the nut 35 is positioned in a front-back direction by contacting the rear wall of the nut holding portion 37 from the front. In this way, the screw hole 39 of the nut 35 and the bolt insertion hole 33C of the mating terminal connecting portion 34 are aligned.

The nut holding portion 37 has a retreat space 41 a space below the placing portions 40 for avoiding interference with a lower end of the bolt 19 threadedly engaged with the nut 35.

The device-side housing 26 includes a secondary molded part 42 integrally formed to the primary molded part 36. The secondary molded part 42 is formed by arranging the plate 27 and the primary molded parts 36 with the nuts 35 held in the nut holding portions 37 in an unillustrated mold and insert-molding these with synthetic resin. The secondary molded part 42 includes the receptacle 30 described above.

As shown in FIG. 3, the upper surfaces (surfaces on which the mating terminals 17 are to be placed) of the mating terminal connecting portions 34 are at the same height as a projecting end edge 43 of the receptacle 30 or are slightly below the projecting end edge 43 (positions inside the receptacle 30). Further, the nuts 35 are below the mating terminal connecting portions 34 and inside the receptacle 30.

As shown in FIG. 3, the nut holding portions 37 open forward. On the other hand, the mating connector 13 is connected to the device connector 10 from above. As described above, a mounting direction of the nuts 35 into the nut holding portions 37 and a connecting direction of the mating connector 13 to the device connector 10 are different and, in this embodiment, substantially perpendicular to each other.

Further, the receptacle 30 is at a position before the nut holding portions 37.

One possible production process of the device connector 10 is described below. First, the conductive members 18 including the mating terminal connecting portion 34 are formed by press-working the metal plate material. The conductive members 18 then are arranged in an unillustrated mold and insert-molded with synthetic resin to form the primary molded parts 36. Subsequently, the nuts 35 are press-fit from the front into the nut holding portions 37 of the primary molded parts 36. The nuts 35 are pushed until coming into contact with the rear walls of the nut holding portions 37 from the front. The secondary molded part 42 is formed by arranging six primary molded parts 36 in which the nut 35 is press-fitted and the plate 27 in the unillustrated mold and insert-molding these with synthetic resin to form the device connector 10.

Figure 6:
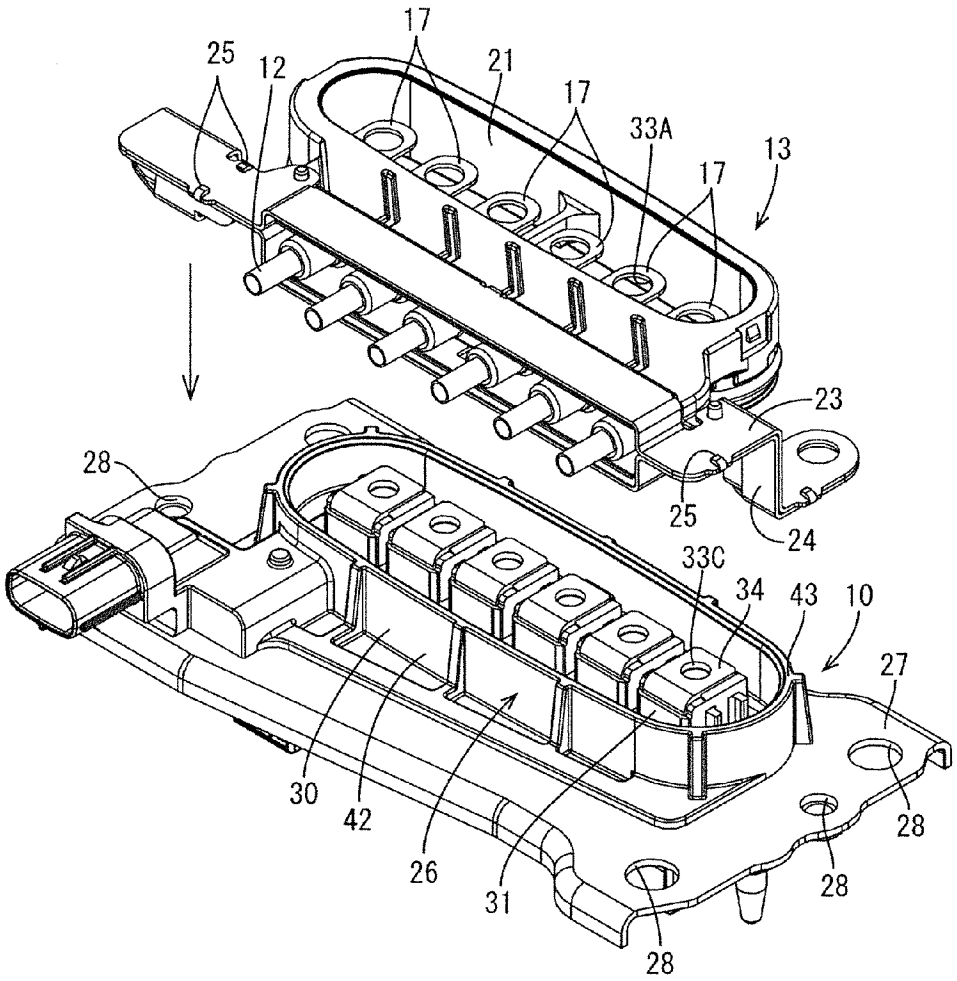
FIG. 6 is a perspective view showing the state before the device connector and the mating connector are connected.

As shown in FIGS. 3 and 6, the mating connector 13 is fitted into the receptacle 30 of the device connector 10 from above. Then, the mating terminals 17 are placed on the upper surfaces of the mating terminal connecting portions 34. Subsequently, the bolts 19 are inserted into the mating connector 13 through the work hole 21. The bolts 19 are inserted through the bolt insertion holes 33A of the mating terminals 17 and the bolt insertion holes 33C of the mating terminal connecting portions 34 from above and threadedly engaged with the screw holes 39 of the nuts 35 from above. Thereafter, the bolts 19 are threadedly engaged with the nuts 35 by a tool (not shown) inserted through the work hole 21. In this way the mating connector 13 and the device connector 10 are connected electrically.

In this embodiment, the device-side housing 26 includes the primary molded parts 36 in which the conductive member 18 is arranged and include the nut holding portion 37 for holding the nut 35. The secondary molded part 42 is formed integrally to the primary molded parts 36 and includes the tubular receptacle 30 into which the mating connector 13 is to be fit. According to the above configuration, the secondary molded part 42, including the receptacle 30, is molded after the nuts 35 are held in the primary molded parts 36. Thus, the nuts 35 can be arranged in the receptacle 30 without providing openings on a side wall of the receptacle 30 through which the nuts 35 are press-fit. As a result, the height of the receptacle 30 can be reduced, and the height of the device connector 10 as a whole can be reduced.

The surfaces of the mating terminal connecting portions 34 on which the mating terminals 17 are to be placed are arranged at the same height as the projecting end edge 34 of the receptacle 30 or arranged inside the receptacle 30. This prevents the mating terminal connecting portions 34 from projecting outward from the projecting end edge 43 of the receptacle 30. As a result, an operator will not contact the mating terminal connecting portions 34 while connecting the mating connector 13 and the device connector 10. In this way, safety in the connecting operation of the mating connector 13 and the device connector 10 can be improved.

The invention is not limited to the above described embodiment. For example, the following embodiments are also included in the scope of the invention.

The mating terminal 17 is connected to the wire 12 in this embodiment. However, the mating terminal 17 may be formed on one end part of a busbar. In this case, other end parts of the busbar may be connected to other devices 11.

Six conductive members 18 are arranged in the device connector 10 in this embodiment. However, more or fewer conductive members 18 may be provided.

The upper surface of the mating terminal connecting portion 34 may be located above the height of the projecting end edge 43 of the receptacle 30.

The wires 12 are surrounded collectively by the tubular braided wire 22 made of thin metal wires in this embodiment. However, a sheet-like braided member made of thin metal wires may be rolled into a tubular shape for collectively surrounding the wires 12 or a sheet-like braided member may be placed only on an upper side of the wires 12.

LIST OF REFERENCE SIGNS

10: device connector
11: device
13: mating connector
18: conductive member
19: bolt
26: device-side housing
30: receptacle
34: mating terminal connecting portion
35: nut
36: primary molded part
37: nut holding portion
42: secondary molded part
43: projecting end edge

What is claimed is:

1. A device connector to be mounted on a device and connected to a mating connector, comprising:

a conductive member that electrically connects the device and the mating connector;

at least one primary molded part formed integrally with the conductive member, the at least one primary molded part having a side surface with a nut holding portion extending therein in a direction normal to the connecting direction, and a mating terminal connecting portion normal to the side surface and having a bolt insertion hole extending into the nut holding portion in the connecting direction;

a nut arranged in the nut holding portion;

a secondary molded part integrally formed to the primary molded part, the secondary molded part including a tubular receptacle having a continuous peripheral wall projecting in the connecting direction into which the mating connector is to be fit; and a bolt inserted through the bolt insertion hole of the mating terminal connecting portion and threadedly engaged with the nut to electrically connect the device connector and the mating connector.

2. The device connector of claim 1, wherein a surface of the mating terminal connecting portion on which a mating terminal is to be placed is arranged at a position at the same height as a projecting end edge of the receptacle or arranged inside the receptacle.

3. The device connector of claim 1, further comprising a plate having opposite first and second surfaces and a device-side housing opening formed in the plate and extending between the first and second surfaces, wherein the secondary molded portion is mounted in the device-side housing opening.

4. The device connector of claim 3, wherein the secondary molded portion is formed integrally with the plate.

5. The device connector of claim 3, wherein the plate is formed with a at least one mounting hole for connecting the plate to the device.

6. The device connector of claim 3, wherein the secondary molded portion penetrates at least partially into the device-side housing opening.

7. The device connector of claim 1, wherein a retreat space is formed in the nut holding portion opposite the bolt insertion hole and is configured for receiving a leading end of the bolt that has been threadedly engaged with the nut.

8. The device connector of claim 1, wherein the at least one primary molded portion comprises a plurality of primary molded portions and the secondary molded portion is formed integrally with the plurality of primary molded portions.

9. The device connector of claim 1, further comprising a sealing ring fit externally on the mating connector and held in close contact with an inner peripheral wall of the receptacle.

* * * * *